US007963669B2

(12) United States Patent
Hockel et al.

(10) Patent No.: US 7,963,669 B2
(45) Date of Patent: Jun. 21, 2011

(54) MODULAR LIGHTING SYSTEM AND LIGHTING ARRANGEMENT

(75) Inventors: Jens Florian Hockel, Müchen (DE); Ralf Boing, Bielefeld (DE); Stephan Lukanow, Vachendorf (DE); Birgit Wels, Müchen (DE)

(73) Assignee: OSRAM Gesellschaft mit beschränkter Haftung, München (DE)

( * ) Notice: Subject to any disclaimer, the term of this patent is extended or adjusted under 35 U.S.C. 154(b) by 503 days.

(21) Appl. No.: 11/788,892

(22) Filed: Apr. 23, 2007

(65) Prior Publication Data

US 2008/0036397 A1 Feb. 14, 2008

(30) Foreign Application Priority Data

Apr. 21, 2006 (DE) ..... 10 2006 018 668

(51) Int. Cl.
*F21V 21/00* (2006.01)

(52) U.S. Cl. ..... 362/249.02; 362/219; 362/235

(58) Field of Classification Search ..... 362/249.02, 362/219, 635

See application file for complete search history.

(56) References Cited

U.S. PATENT DOCUMENTS

| | | | | |
|---|---|---|---|---|
| 4,924,362 | A * | 5/1990 | Janko et al. | 362/108 |
| 5,672,000 | A * | 9/1997 | Lin | 362/249.06 |
| 5,924,785 | A * | 7/1999 | Zhang et al. | 362/241 |
| 6,017,241 | A * | 1/2000 | Komai | 439/419 |
| 6,074,074 | A * | 6/2000 | Marcus | 362/240 |
| 6,837,598 | B2 * | 1/2005 | Marcus | 362/374 |
| 6,932,495 | B2 * | 8/2005 | Sloan et al. | 362/294 |
| 7,165,863 | B1 * | 1/2007 | Thomas et al. | 362/219 |
| 7,442,070 | B2 * | 10/2008 | Lee | 439/417 |
| 7,458,705 | B2 * | 12/2008 | Chiba et al. | 362/362 |
| 7,611,376 | B2 * | 11/2009 | Daily et al. | 439/419 |
| 2001/0007526 | A1 * | 7/2001 | Ohkohdo et al. | 362/249 |
| 2003/0081413 | A1 * | 5/2003 | Weedon | 362/219 |
| 2006/0146553 | A1 * | 7/2006 | Zeng et al. | 362/488 |
| 2008/0030981 | A1 * | 2/2008 | Mrakovich et al. | 362/219 |

FOREIGN PATENT DOCUMENTS

WO WO 2005043637 A1 * 5/2005

* cited by examiner

*Primary Examiner* — Evan Dzierzynski

(74) *Attorney, Agent, or Firm* — Cohen Pontani Lieberman & Pavane LLP

(57) ABSTRACT

A modular lighting system having a plurality of light modules, which each have a plurality of light modules accommodating at least one light-emitting diode module. The light modules have at least two mounting clearances, which run substantially parallel, and a mounting rod passes through each mounting clearance for mechanical fixing and electrical contact-making purposes. The mounting clearances are formed on the luminaire body. A lighting arrangement of such lighting systems is also disclosed.

24 Claims, 6 Drawing Sheets

MODULAR LIGHTING SYSTEM AND LIGHTING ARRANGEMENT

RELATED APPLICATION

This patent application claims the priority of the German patent application 10 2006 018 668.0 filed on Apr. 21, 2006, the disclosure content of which is hereby incorporated by reference.

FIELD OF THE INVENTION

The invention relates to a modular lighting system having a plurality of light modules, which each have a luminaire body, and to a lighting arrangement having a plurality of such lighting systems.

BACKGROUND OF THE INVENTION

A lighting system having a large number of luminaires is described, for example, on the Internet domain www.paulmann.de under the product designation "Light & Easy". With this conventional lighting system, a halogen reflector lamp is inserted into a luminaire body for each luminaire, which luminaire body is pivotably connected to two holding feet. The holding feet are fixed onto two approximately parallel-running mounting cables for the purpose of mechanically holding and making electrical contact with the luminaire. Disadvantages with such lighting systems are, for example, that they require a large amount of installation space and are not suitable for forming surface lighting.

SUMMARY OF THE INVENTION

One object of the invention is to provide a lighting system and a lighting arrangement which make variable illumination possible given a compact design in comparison with conventional solutions.

This and other objects are attained in accordance with one aspect of the invention directed to a modular lighting system having a plurality of light modules, which each have a luminaire body for accommodating at least one light-emitting diode module, the light modules having at least two mounting clearances, which run substantially parallel and through each of which a mounting rod passes for mechanical fixing and electrical contact-making purposes, the mounting clearances being formed on the luminaire body.

This object is further achieved by a lighting arrangement of such lighting systems. The lighting system according to an embodiment of the invention has, in comparison to the prior art, a substantially more compact design, since the mounting clearances are formed directly in the luminaire body and not in a separate holding foot.

Owing to the luminaire bodies which are fixed replaceably on the mounting rods, the lighting system can be matched in variable fashion to different illumination and lighting tasks by replacing or changing the position of the light modules, so that the lighting system according to an embodiment of the invention has a high degree of variability in terms of the lighting options. Thus, any desired combination of the light modules in a lighting system is possible, so that a very wide variety of lighting effects, for example light colors, accents or light dynamics can be realized. In particular, RGB light-emitting diode modules can be used which output specific light colors depending on the driving.

In accordance with one configuration, the light-emitting diode modules, for example OSTAR® or DRAGON® light-emitting diode modules available from the company OSRAM Opto Semiconductors are accommodated within the luminaire bodies.

In a further configuration, the light modules are arranged adjacent, in particular so as to adjoin one another, on the mounting rods and form sections of what is perceived by the viewer to be a common luminous area.

In one configuration, the light modules have an approximately cuboid or parallelepipedal basic body having substantially identical mounting dimensions. Owing to the identical mounting dimensions, the light modules can be arranged in a simple and variable manner on the mounting rods, with the result that a high degree of variance of the lighting options is achieved by a combination of the standardized modules. Furthermore, owing to the identical mounting dimensions, an optically responsive, fixed division of the light spots is possible. Such a body can be produced in a manner which is advantageous in terms of manufacturing as a milled part from an aluminum alloy, for example.

In terms of manufacturing it is preferred if the mounting clearances are in the form of through-holes opening out into side faces of the luminaire body.

In order to accommodate the light-emitting diode module, in one configuration the light modules each have an interior, at least part of which is covered by a cover plate for mechanical protection and/or beam forming purposes. This cover plate can be held detachably on the luminaire body in a force-fitting and/or interlocking manner. For example, the cover plate is inserted from above into the luminaire body and fixed to the luminaire body by means of a latching connection or a holding ring, which is positioned at the front side and is screwed to the luminaire body.

In a development of this configuration, the cover plate is provided with optics for deflecting the light emitted by the light-emitting diode module.

In addition to the light-emitting diode module, in one configuration a current-regulating board is inserted into the interior of the luminaire body. In one development, the current-regulating board has a cutout for the light-emitting diode module, with the result that said light-emitting diode module abuts in a thermally conductive manner, possibly provided with a thermally conductive paste, an inner wall of the luminaire body. Thus, the heat dissipation of the light-emitting diode module can be considerably improved, so that a high luminous efficiency is achieved.

In one configuration of the lighting system, at least part of the light-emitting diode module is arranged in a depression of the inner wall, so that the heat dissipation of the light-emitting diode module to the cooling-optimized luminaire body is further improved.

In another configuration, the inner wall of the luminaire body is provided with apertures in the region of the mounting rods for the purposes of transmitting power and/or signals. In an expedient development, contact elements of the current-regulating board which are electrically connected to the mounting rods, for example sliding contacts, enter into the apertures.

In a further configuration, the mounting clearances are provided with insulating sleeves consisting of an electrically nonconductive plastic outside of the contact region of the contact elements, so that the current-carrying mounting rods are electrically insulated from the luminaire bodies.

In one configuration of the lighting system, the light modules have at least four mounting clearances, which open out into a side face, for accommodating the mounting rods. Thus, the light modules can be contacted and driven individually, so that different light effects (dimming, color control etc.) are possible.

In a further configuration of the lighting system, the luminaire bodies are designed in thermally optimized fashion and have at least one cooling face provided with cooling ribs in order to dissipate the loss heat originating from the light-emitting diode modules and in particular the loss heat from the power electronics of the light-emitting diodes. For example, the side faces are provided with cooling ribs arranged in recesses of the side walls of the luminaire body. It is further preferred if the luminaire body is provided with cooling ribs in corner regions or on the base, the base-side cooling ribs running radially outwards approximately from the mid-point of a rear wall. Owing to the distance between the cooling ribs which expands outwards, an effective supply of cooling air and, as a result, improved heat dissipation are possible.

In accordance with another configuration, the luminaire bodies have further mounting clearances for mounting rods, which further mounting clearances run at an angle of approximately 90° and vertically offset with respect to the through-holes.

The lighting system can be operated, for example, using low-volt technology with a secondary voltage in the range from approximately 10 to 24V and can be designed so as to correspond to Protection Class IP65.

A lighting arrangement according to an embodiment of the invention for forming an area lighting uses a plurality, in particular a large number, of such lighting systems, which are arranged substantially parallel to one another and form sections of what is perceived by the viewer to be a common luminous area.

BRIEF DESCRIPTION OF THE DRAWINGS

Exemplary embodiments of the invention are described below in conjunction with FIGS. 1 to 5, in which.

DETAILED DESCRIPTION OF THE DRAWINGS

Identical or functionally identical parts are in each case provided with the same reference symbols in the exemplary embodiments and Figures.

Figure 1:
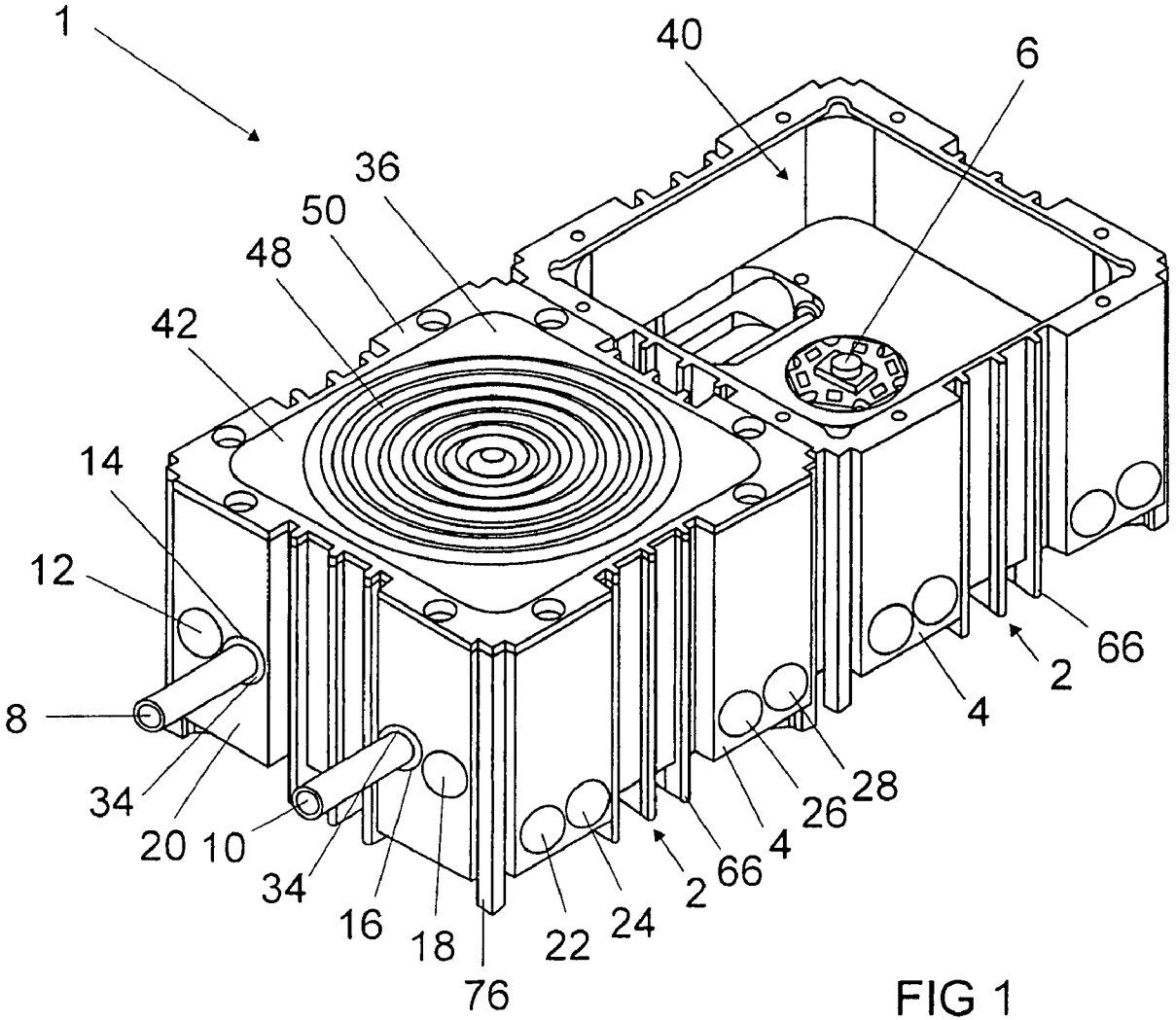
FIG. 1 shows a schematic illustration of a modular lighting system.

FIG. 1 shows a schematic illustration of a modular lighting system 1 having two light modules 2, which each have a luminaire body 4 for accommodating a light-emitting diode module 6 and are connected via mounting rods 8, 10. The light-emitting diode modules 6 are arranged within the luminaire bodies 4, which have at least two parallel-running mounting clearances 12, 14, 16, 18 through each of which one of the mounting rods 8, 10 passes for mechanically fixing and making electrical contact with the light modules 2.

In the exemplary embodiment illustrated, four mounting clearances 12, 14, 16, 18, for accommodating mounting rods 8, 10 and further mounting rods (not illustrated) are provided, which open out in the form of through-holes into a side face 20 of the luminaire body 4. In this way, the light modules 2 can be contacted and driven individually, so that different light effects (dimming, color control etc.) are possible. The light modules 2 are furthermore provided with four further mounting clearances 22, 24, 26, 28, which run at an angle of 90° and are vertically offset with respect to the mounting clearances 12, 14, 16, 18, for accommodating transversely running mounting rods 30, 32 (see FIG. 5).

Insulating sleeves 34 consisting of an electrically nonconductive plastic are fixed in the through-holes 14, 16, through which mounting rods 8, 10 pass, so that the current-carrying mounting rods 8, 10 are electrically insulated from the luminaire bodies 4. The inner diameter of the insulating sleeves 34 is designed such that the light modules 2 are held displaceably, subject to friction, on the tubular mounting rods 8, 10.

In accordance with the illustrated exemplary embodiment of the invention, the light modules 2 are arranged adjacent on the mounting rods 8, 10 and form, in sections, a common luminous area 36. The mounting rods 8, 10 can be fixed to a ceiling, a wall, an item of furniture or the like via fixing elements (not illustrated).

The lighting system 1 according to the invention has a compact design, since the light-emitting diode modules 6 are each accommodated within the luminaire body 4, and the mounting clearances 12, 14, 16, 18, 22, 24, 26, 28 are formed directly in the luminaire body 4. Owing to the luminaire bodies 4 which can be fixed replaceably to the mounting rods 8, 10, the lighting system 1 can be matched variably to different illumination and lighting tasks by replacing or changing the position of the light modules 2, so that the lighting system 1 according to the invention is characterized by a high degree of integration of the light-emitting diode modules 6 in the luminaire bodies 4 and variability of the lighting options. Thus, any desired combination of the light modules 2 in a lighting system 1 is possible, so that a very wide variety of light effects, for example light colors, accents or light dynamics, can be realized.

In the exemplary embodiment illustrated, light-emitting diode modules 6 of the type OSTAR® are used. In particular, the use of RGB light-emitting diode modules 6 which output specific light colors depending on the driving is possible. The lighting system 1 according to an embodiment of the invention can be operated, for example, using low-volt technology with a secondary voltage in the range from 10 to 24 V and can be designed so as to correspond to Protection Class IP65.

Figure 2:
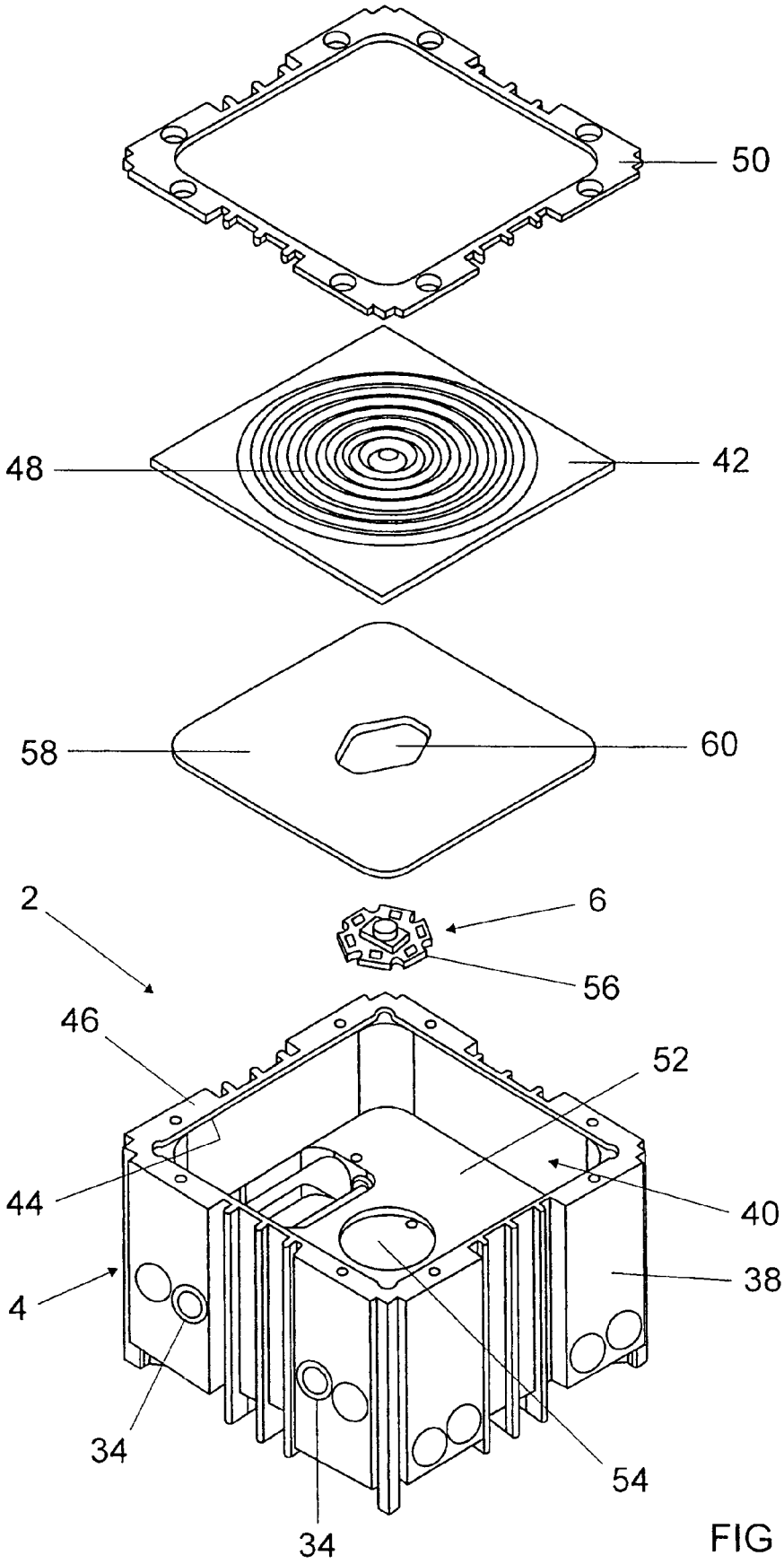
FIG. 2 shows a schematic exploded view of a light module from FIG. 1.

As can be seen in particular in FIG. 2, which shows a schematic exploded view of a light module 2 from FIG. 1, the light modules 2 each have an approximately cuboid or parallelepipedal basic body 38 having identical mounting dimensions. Owing to the identical mounting dimensions, the light modules 2 can be arranged in a simple and variable manner on the mounting rods 8, 10 (see FIG. 1), so that a high degree of variance of the lighting options is achieved by a combination of the standardized modules.

In order to accommodate the light-emitting diode module 6, the light modules 2 each have an interior 40, which is closed by a cover plate 42. This cover plate 42 can be inserted into a stepped shoulder 44 at a front side of the luminaire body 4 and terminates flush with a front face 46 of the luminaire body 4.

In the exemplary embodiment illustrated, the cover plate 42 is provided with optics 48 for deflecting the light emitted by the light-emitting diode module 6 and can be fixed to the luminaire body 4 by means of a holding ring 50, which is positioned on the front side and screwed to the luminaire body 4.

The holding ring 50 is matched to the outer contour of the luminaire body 4 and engages over an edge region of the cover plate 42, with the result that the latter is fixed in the luminaire body 4. In a variant which is not illustrated, the cover plate 42 is held on the luminaire body 4 by means of a latching connection.

In order to accommodate the light-emitting diode module 6, an inner wall 52 of the luminaire body 4 is provided with an approximately circular depression 54, which is matched to the outer diameter of the light-emitting diode module 6. The depth of the depression approximately corresponds to the height of a base board 56 of the light-emitting diode module 6.

In addition to the light-emitting diode module 6, a current-regulating board 58 is inserted into the interior 40 of the luminaire body 4. The current-regulating board 58 is illustrated schematically. It is fitted with electronic components (not illustrated) and provided approximately centrally with a cutout 60 for the light-emitting diode module 6, so that at least part of said light-emitting diode module 6 is arranged under the current-regulating board 58 and abuts in a thermally conductive manner, possibly provided with a thermally conductive paste, the inner wall 52 of the luminaire body 4. In some embodiments, module 6 projects somewhat from cutout 60, while in other embodiments it is completely contained so that it is within depression 54 and does not project beyond cutout 60. In this way, the heat dissipation of the light-emitting diode module 6 to the luminaire body 4 can be considerably improved, which results in high luminous efficiency.

Figure 3:
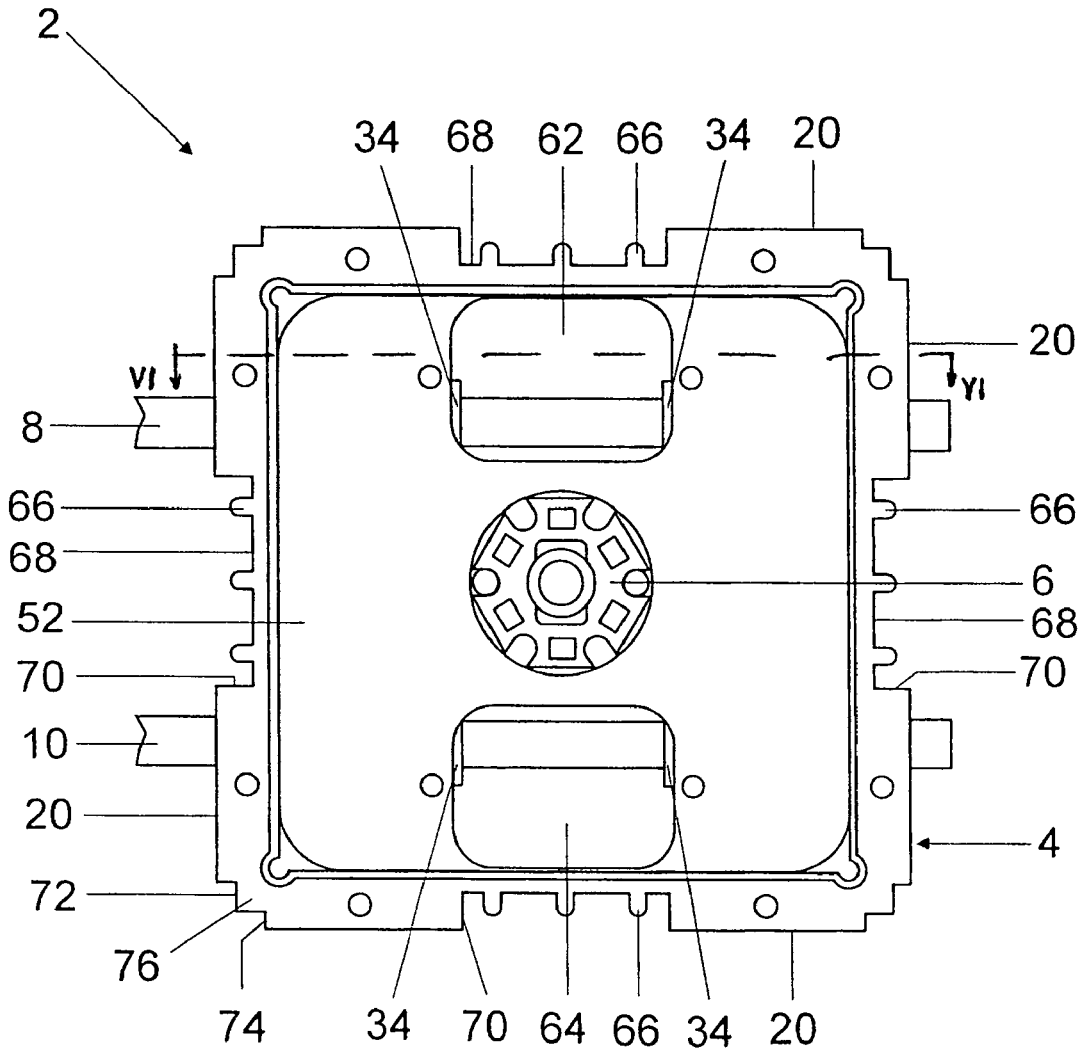
FIG. 3 shows a schematic plan view of a light module without cover plate and current-regulating board.

As shown in FIG. 3, which shows a plan view of a light module 2 without cover plate 42 and current-regulating board 58, the inner wall 52 of the luminaire body 4 is provided with apertures 62, 64 in the region of the mounting rods 8, 10 for the purpose of transmitting power and/or signals. Into the apertures, contact elements, preferably sliding contacts, of the current-regulating board 58 (see FIG. 2) enter. The contact elements are electrically connected to the mounting rods 8, 10.

Figure 6:
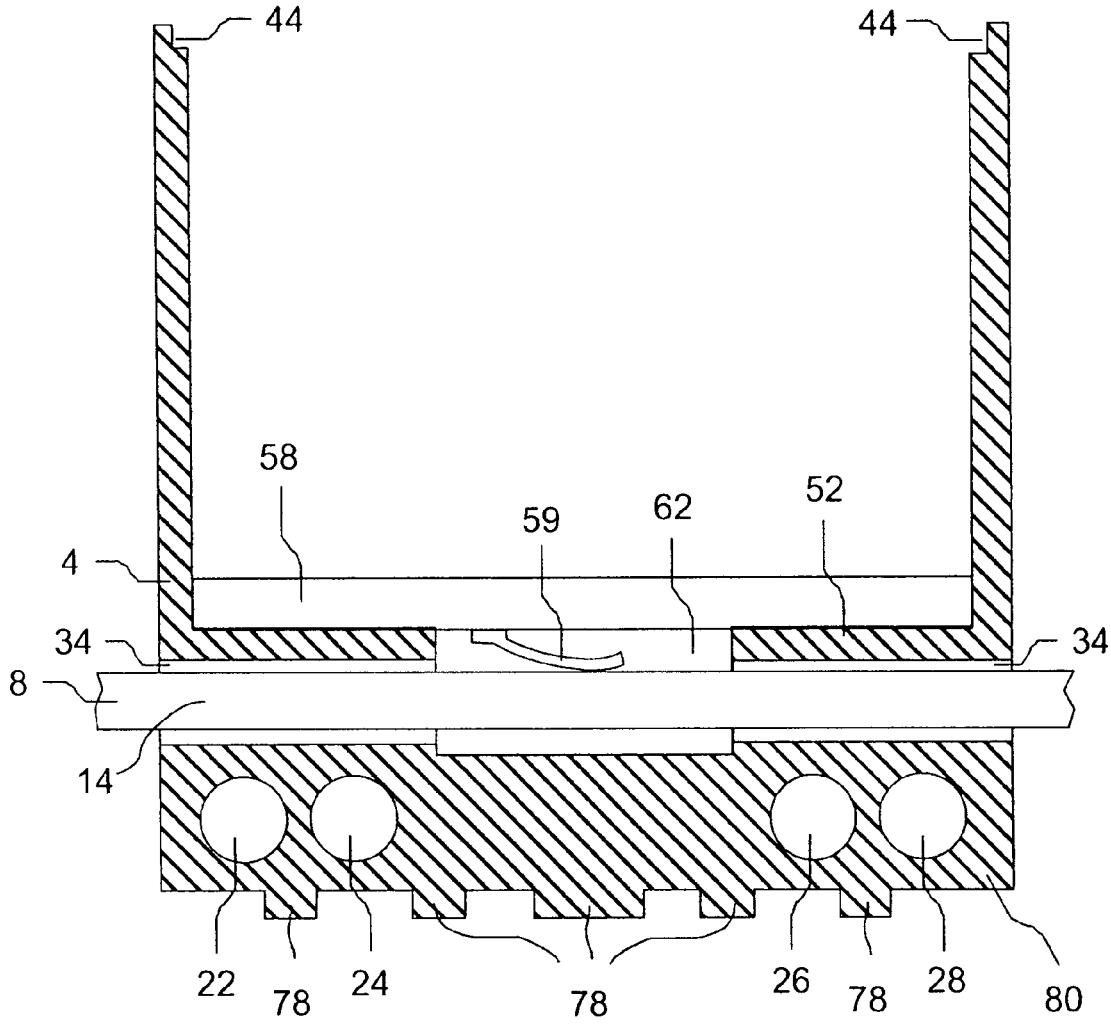
FIG. 6 shows a schematic view taken at line VI-VI of FIG. 3, but without cover plate and holding ring.

FIG. 6 shows a schematic sectional view through the basic body 38 of the light module 4. Cover plate 42 and holding ring 50 are not shown, for simplicity. Contact element 59, which is attached to the current regulating board 58, enters into aperture 62. The contact element 59 is, for example, formed as a sliding contact. In particular, it has the form of a spring, preferably a metallic spring. In one embodiment, the spring is formed as a curved metallic strip. It mechanically and electrically contacts mounting rod 8 which extends through aperture 62. In particular, it is pressed against mounting rod 8 by elastic force.

Figure 4:
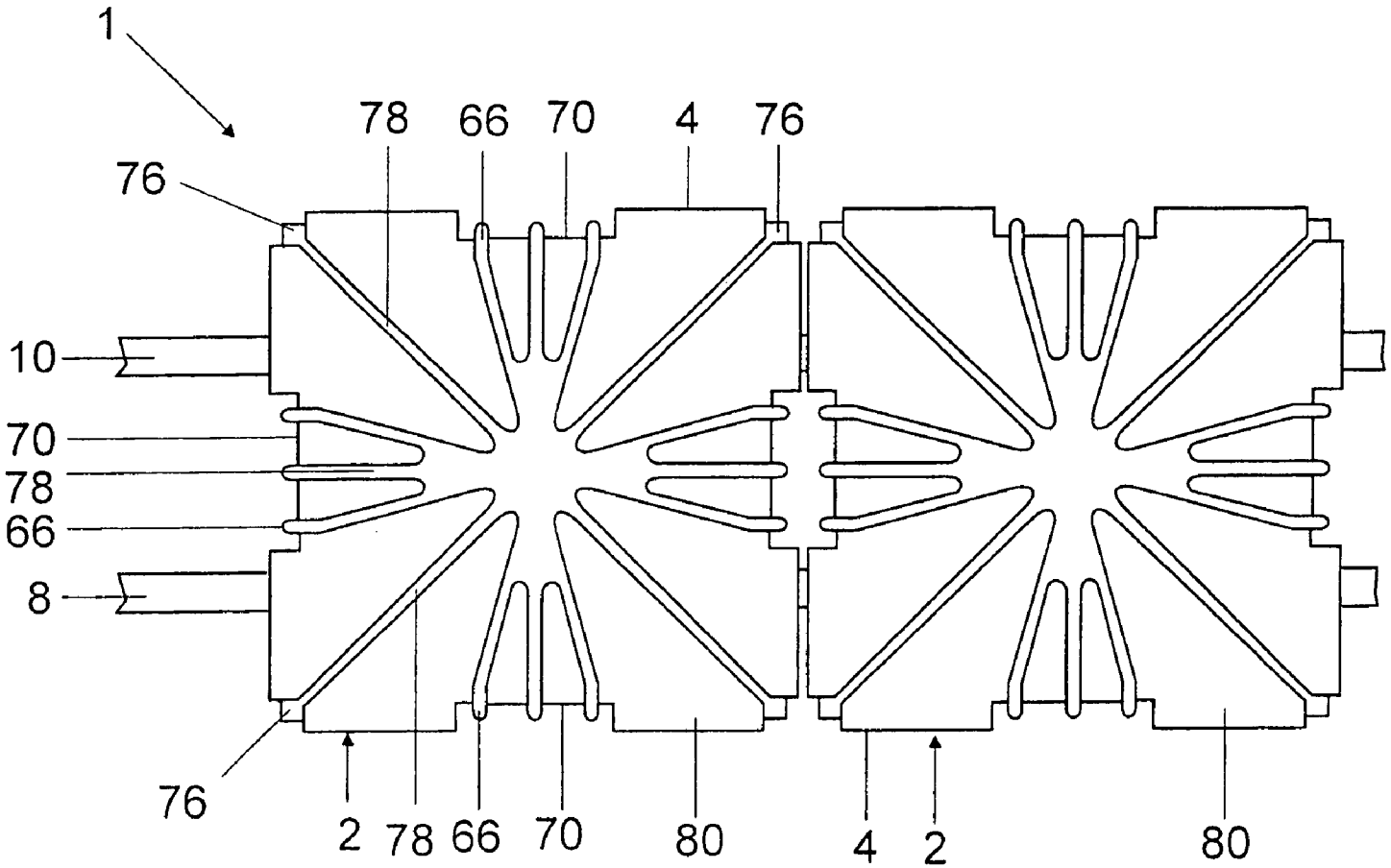
FIG. 4 shows a schematic view from below of the lighting system from FIG. 1.

In one exemplary embodiment, the apertures 62, 64 do not pass through a rear wall 80, which delimits the luminaire body 4 at the rear and is illustrated in FIG. 4. For example, the inner wall 52 and the rear wall 80 are formed integrally as a rear-side wall of the luminaire body, the inner wall 52 being an inner portion of the rear-side wall which faces the interior 40, and the rear wall 80 being an outer portion of the rear-side wall which faces away from the interior 40. In this exemplary embodiment, the mounting clearances 12, 14, 16, 18, 22, 24, 26, 28 preferably run in the rear-side wall. The apertures 62, 64 in this exemplary embodiment represent depressions in the rear-side wall. Other configurations of the inner wall 52 and the rear wall 80 are likewise possible.

The insulating sleeves 34 are each introduced into the through-openings 14, 16 (see FIG. 1) from the outside, so that the contact region of the mounting rods 8, 10 is exposed for the purpose of making electrical contact, and the current-carrying mounting rods 8, 10 are electrically insulated from the luminaire body 4.

The luminaire bodies 4 are thermally optimized and have cooling faces 68 provided with cooling ribs 66 in order to dissipate the loss heat originating from the light-emitting diode modules 6 and in particular the loss heat from the power electronics of the light-emitting diode modules 6. In the exemplary embodiment illustrated, the side faces 20 of the luminaire body 4 are each provided with cooling ribs 66, which are arranged in recesses 70 and run in the light-emission direction. Furthermore, a cooling rib 76 is formed by two recesses 72, 74 in each of the corner region's of the luminaire body 4.

As can be seen in particular in FIG. 4, which shows a schematic view from below of the lighting system 1 shown in FIG. 1, the luminaire bodies 4 are provided on the base side with cooling ribs 78, which run radially outwards approximately from the mid-point of the rear wall 80 of the luminaire body 4 and merge with the cooling ribs 66, 76 of the recesses 70 of the luminaire body 4 and corner regions. Owing to the distance between the cooling ribs 78 which expands outwards, an effective supply of cooling air and, as a result, improved heat dissipation are made possible, so that the luminous efficiency of the lighting system 1 is further improved with reduced installation space.

In one embodiment, the basic body 38 is formed in one piece. For example, it is die casted, in particular from aluminum. Recesses 70, 72, 74, cooling ribs 66, 76, 78, mounting clearances 12, 14, 16, 18, 22, 24, 26, 28 and apertures 62, 64 are, for example, formed by the mold during casting, by drilling and/or by milling. In this embodiment, the rear-side wall usually is formed as one piece and the light module does not have a double bottom. A massive basic body 38 has the advantage that efficient dissipation of loss heat from the light-emitting diode module is achieved. Even with high-power light emitting diode modules like the OSTAR module, the light modules can usually be cooled passively, i.e. only by dissipating loss heat via the luminaire body. Active cooling with a fan or the like is not necessary. Passive cooling is, for example, possible for light-emitting diode modules having a power consumption as high as 5 W or more, in particular as high as 10 W or more. In one embodiment, the light-emitting diode module in a passively cooled light module has an electrical power consumption of 12 W.

Figure 5:
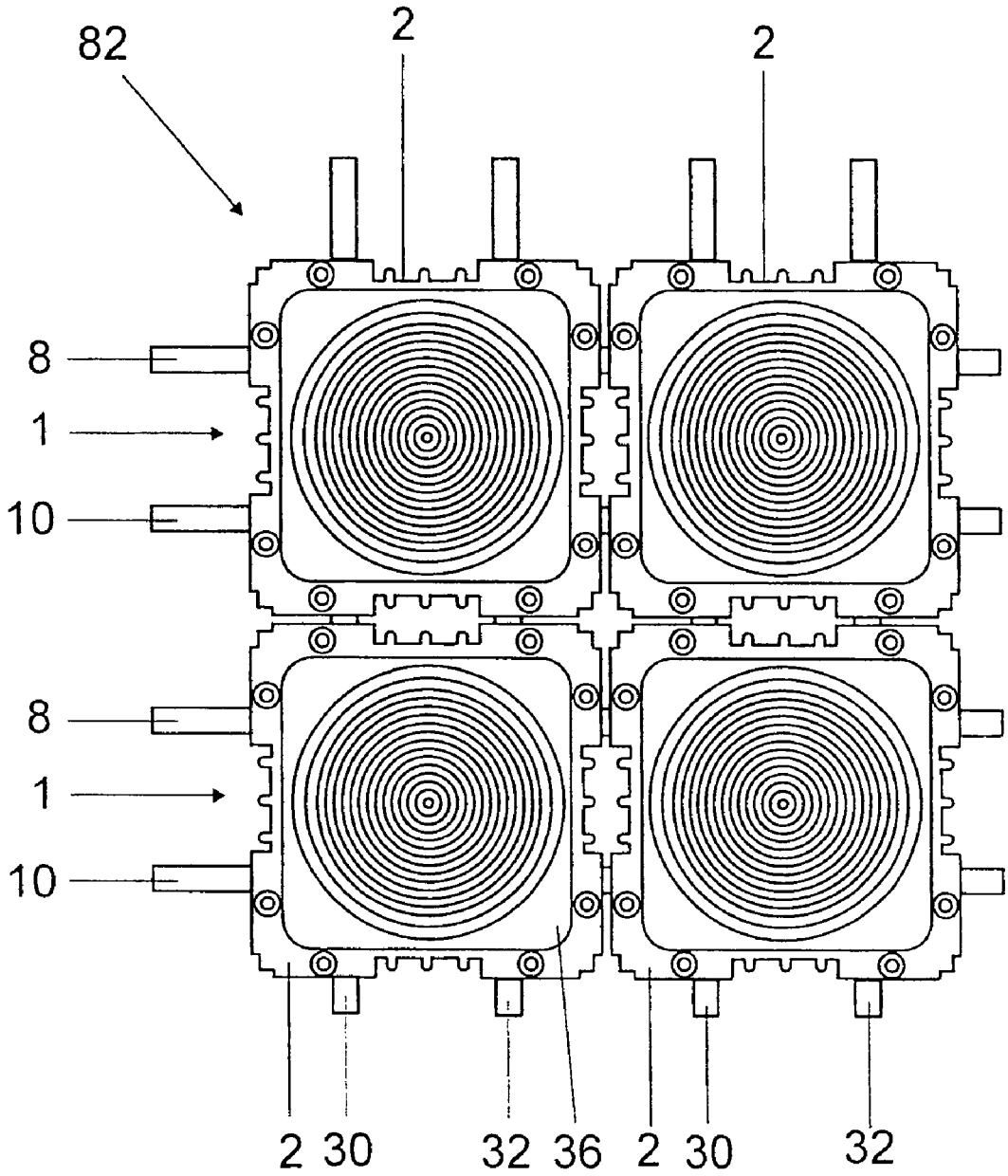
FIG. 5 shows a schematic illustration of a lighting arrangement.

FIG. 5 shows an exemplary embodiment of a lighting arrangement 82 for forming an area lighting which has two lighting systems 1, which are arranged parallel to one another, each having two adjacent light modules 2, which form sections of what is perceived by the viewer to be a common luminous area 36. The light modules 2 are each connected via the mounting rods 8, 10 and further mounting rods 30, 32, which run at an angle of 90° and vertically offset (see FIG. 1) with respect to said mounting rods 8, 10, so that a stable lighting unit is formed.

The lighting system 1 according to the invention and the lighting arrangement 82 are not restricted to the light-emitting diode modules 6 illustrated, but the light modules 2 can be provided with different light-emitting diode modules 6 known from the prior art or a light-emitting diode arrangement. The light module arrangements illustrated, as has already been explained at the outset, have merely been selected by way of example and, owing to the modular character of the lighting system 1 according to the invention, can be varied and extended as desired. Furthermore, the luminaire bodies 4 are not restricted to the cuboid or parallelepipedal basic bodies 38 illustrated, for example the luminaire bodies 4 may be approximately circular, in other words cylindrical, spherical or in the form of a segment of a sphere.

The disclosed modular lighting system 1 has a plurality of light modules 2, which each have a luminaire body 4 for accommodating at least one light-emitting diode module 6, the light modules 2 having at least two mounting clearances 12, 14, 16, 18, which run substantially parallel, a mounting rod 8, 10 passing through each mounting clearance for mechanical fixing and electrical contact-making purposes. The mounting clearances 12, 14, 16, 18 are formed on the luminaire body 4. Furthermore, the invention discloses a lighting arrangement 82 of such lighting systems 1.

The invention is not restricted by the description, with reference to the exemplary embodiments, to these exemplary embodiments. Instead, the invention includes any new feature and any combination of features which contains in particular any combination of features in the patent claims, even if this feature or this combination itself is not explicitly mentioned in the patent claims or exemplary embodiments.

We claim:

1. A modular lighting system comprising:

a plurality of light modules, a first mounting rod, and a second mounting rod, wherein each of the plurality of light modules has a luminaire body accommodating at least one light-emitting diode module and at least four mounting clearances formed in the respective luminaire bodies, wherein the at least four mounting clearances extend substantially parallel to each other and are each a through-hole opening into side faces of the respective luminaire bodies; and wherein the first mounting rod selectively passes through a first mounting clearance of the at least four mounting clearances of the plurality of light modules and the second mounting rod selectively passes through a second mounting clearance of the at least four mounting clearances of the plurality of light modules for mechanically fixing the plurality of light modules and for electrically contacting the light-emitting diode modules.

2. The lighting system as claimed in claim 1, wherein each of the light-emitting diode modules is arranged within an individual luminaire body.

3. The lighting system as claimed in claim 2, wherein the light modules are arranged adjacent to one another on the first and second mounting rods.

4. The lighting system as claimed in claim 3, wherein the light modules directly adjoin each other to form sections of a common luminous area.

5. The lighting system as claimed in claim 1, wherein the light modules have an approximately cuboid or parallelepipedal basic body having substantially identical mounting dimensions.

6. The lighting system as claimed in claim 1, wherein each of the luminaire bodies has an interior for accommodating the at least one light-emitting diode module.

7. The lighting system as claimed in claim 6, further comprising at least one current-regulating board inserted into the interior of the each of the luminaire bodies.

8. The lighting system as claimed in claim 7, wherein the current-regulating board has a cutout for the at least one light-emitting diode module, so that the at least one light-emitting diode module abuts in a thermally conductive manner an inner wall of the respective luminaire body.

9. The lighting system as claimed in claim 8, wherein at least a part of the at least one light-emitting diode module is arranged in a depression of the inner wall.

10. The lighting system as claimed in claim 9, wherein the current-regulating board partially covers the respective at least one light-emitting diode module and the respective depression.

11. The lighting system as claimed in claim 6, wherein at least part of the interior of the each of the luminaire bodies is covered by a cover plate.

12. The lighting system as claimed in claim 11, wherein the cover plate has optics for directing light emitted by the at least one light-emitting diode module.

13. The lighting system as claimed in claim 11, wherein the cover plate is held in detachable fashion on the each of the luminaire bodies in at least one of a force-fitting and interlocking manner.

14. The lighting system as claimed in claim 8, wherein the inner wall of the respective luminaire body is provided, in a region of the mounting rods, with apertures, into which contact elements of the current-regulating board enter, the contact elements being electrically connected to the mounting rods for transmitting at least one of power and signals.

15. The lighting system as claimed in claim 14, wherein the mounting clearances each are provided with insulating sleeves outside of a contact region of the contact elements.

16. The lighting system as claimed in claim 1, wherein the luminaire bodies are provided, at least in sections, with cooling ribs.

17. The lighting system as claimed in claim 16, wherein the cooling ribs are provided on at least one of side faces and corner regions of the luminaire bodies.

18. The lighting system as claimed in claim 16, wherein the cooling ribs are provided on a base of each of the luminaire bodies.

19. The lighting system as claimed in claim 18, wherein the cooling ribs run radially outwards approximately from a midpoint of a rear wall.

20. The lighting system as claimed in claim 1, wherein the luminaire bodies have further mounting clearances for further mounting rods, and wherein the further mounting clearances extend at an angle of approximately 90° to the at least four mounting clearances and are offset from each other in a vertical direction with respect to the at least four mounting clearances.

21. The lighting system as claimed in claim 1, wherein dimensions of the mounting clearances and the mounting rods are adapted to one another, so that each of the mounting rods is operable to interact with the respective mounting clearance to mechanically fix the luminaire body to the mounting rod by friction fit.

22. A lighting arrangement for forming an area lighting with a plurality of lighting systems as claimed in claim 1, which are arranged substantially parallel to one another and form sections of a common luminous area.

23. The lighting system as claimed in claim 1, wherein the light modules are displaceable with respect to each of the first and second mounting rods along a longitudinal axis of the first and second mounting rods.

24. The lighting system as claimed in claim 1, wherein the mounting clearances further comprise third and fourth mounting clearances extending at an angle of approximately 90° to the first and second mounting clearances and are offset from each other in a vertical direction with respect to the first and second mounting clearances.

* * * * *